US007798859B1

(12) United States Patent
Yang

(10) Patent No.: US 7,798,859 B1
(45) Date of Patent: Sep. 21, 2010

(54) ELECTRICAL TERMINAL

(75) Inventor: Chih-Ling Yang, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/642,770

(22) Filed: Dec. 19, 2009

(51) Int. Cl.
*H01R 24/00* (2006.01)

(52) U.S. Cl. ..... 439/630; 439/733.1

(58) Field of Classification Search ..... 439/630, 439/733.1, 862, 946; 29/883
See application file for complete search history.

(56) References Cited

U.S. PATENT DOCUMENTS 3,497,952 A * 3/1970 Hood et al. ..... 29/876
6,190,213 B1 * 2/2001 Reichart et al. ..... 439/736
6,354,891 B1 * 3/2002 Schnell et al. ..... 439/862
6,832,936 B2 * 12/2004 Peloza et al. ..... 439/736
6,855,013 B2 * 2/2005 Chiang et al. ..... 439/862
7,118,420 B1 * 10/2006 Lai et al. ..... 439/630
7,249,975 B1 * 7/2007 Liu ..... 439/630
7,390,223 B2 * 6/2008 Yu et al. ..... 439/630
7,604,517 B2 * 10/2009 Hsieh et al. ..... 439/733.1
7,682,197 B2 * 3/2010 Wang ..... 439/630

* cited by examiner

*Primary Examiner*—Thanh-Tam T Le

(57) ABSTRACT

An electrical terminal integrated with an insulating housing by means of insert molding includes a base plate embedded in the insulating housing, a soldering portion and a contact portion oppositely extended from two opposite ends of the base plate. A portion of the base plate is perpendicularly punched to divide the base plate into three parts designated as two first fastening plates and a second fastening plate which is connected between the two first fastening plates by two connecting portions. A bend is accordingly formed between the second fastening plate and the first fastening plates. During insert molding, the fluent plastic material flows around the base plate to make the first fastening plates, the second fastening plate and the connecting portions fully and firmly wrapped with the fluent plastic material due to the bend so as to form a firm integration between the electrical terminal and the insulating housing.

4 Claims, 2 Drawing Sheets

ELECTRICAL TERMINAL

BACKGROUND OF THE INVENTION

1. Field of the Invention

The present invention generally relates to a terminal, and more particularly to an electrical terminal used in a card connector.

2. The Related Art

Referring to FIG. 3, a conventional electrical terminal 100' used in a card connector (not shown) is shown. The electrical terminal 100' has a base plate 10' with a bar shape. Two opposite ends of the base plate 10' extend oppositely to form a soldering portion 30' and a contact portion 21'. The electrical terminal 100' is integrated with an insulating housing (not shown) of the card connector by means of insert molding with the base plate 10' for being embedded in the insulating housing, the soldering portion 30' being exposed from one end of the insulating housing for being soldered with a printed circuit board (not shown) and the contact portion 21' being exposed from the other end of the insulating housing for contacting with a corresponding card (not shown). The electrical terminal 100' is fixed in the insulating housing only by means of the base plate 10' being embedded in the insulating housing. However, due to the card being repeatedly inserted into and drawn out from the card connector to contact with the electrical terminal 100', the electrical terminal 100' is apt to move around or flip out from the insulating housing so that the electrical connection between the card and the card connector becomes unstable.

SUMMARY OF THE INVENTION

An object of the present invention is to provide an electrical terminal integrated with an insulating housing by means of insert molding. The electrical terminal includes a base plate embedded in the insulating housing, a soldering portion extended from one end of the base plate, and a contact portion connected with the other end of the base plate. A portion of the base plate is perpendicularly punched to divide the base plate into three parts designated as two first fastening plates and a second fastening plate which is connected between the two first fastening plates by two connecting portions. A bend will be accordingly formed between the second fastening plate and the first fastening plates. During insert molding, the fluent plastic material flows around the base plate to make the first fastening plates, the second fastening plate and the connecting portions fully and firmly wrapped with the fluent plastic material due to the bend between the second fastening plate and the first fastening plates so as to form a firm integration between the electrical terminal and the insulating housing.

As described above, the electrical terminal utilizes the bend between the second fastening plate and the first fastening plates to ensure a firm integration between the base plate and the insulating housing. So a stable electrical connection can be achieved between an external card and the electrical terminals.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
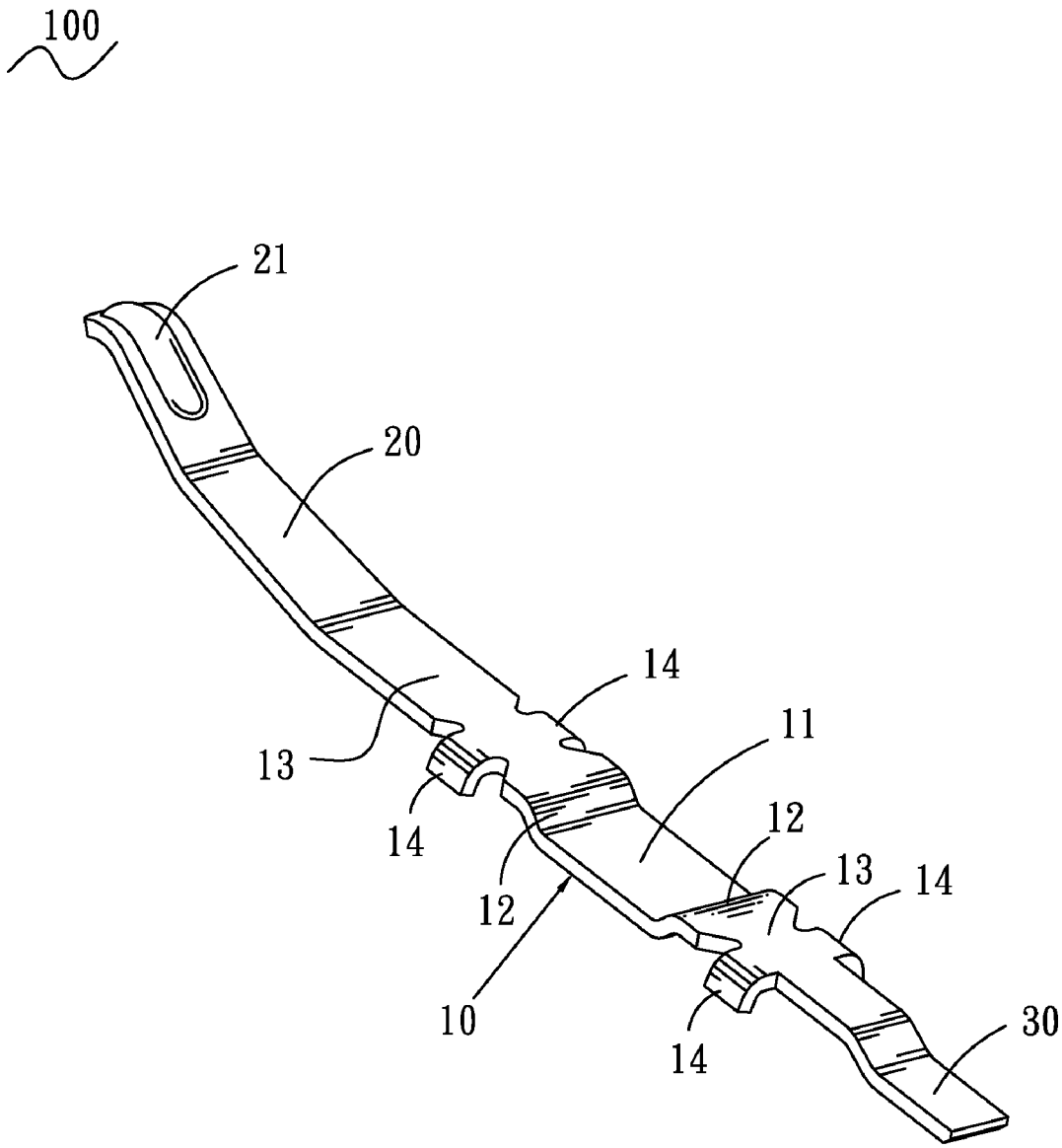
FIG. 1 is a perspective view of an electrical terminal in accordance with the present invention.
Figure 2:
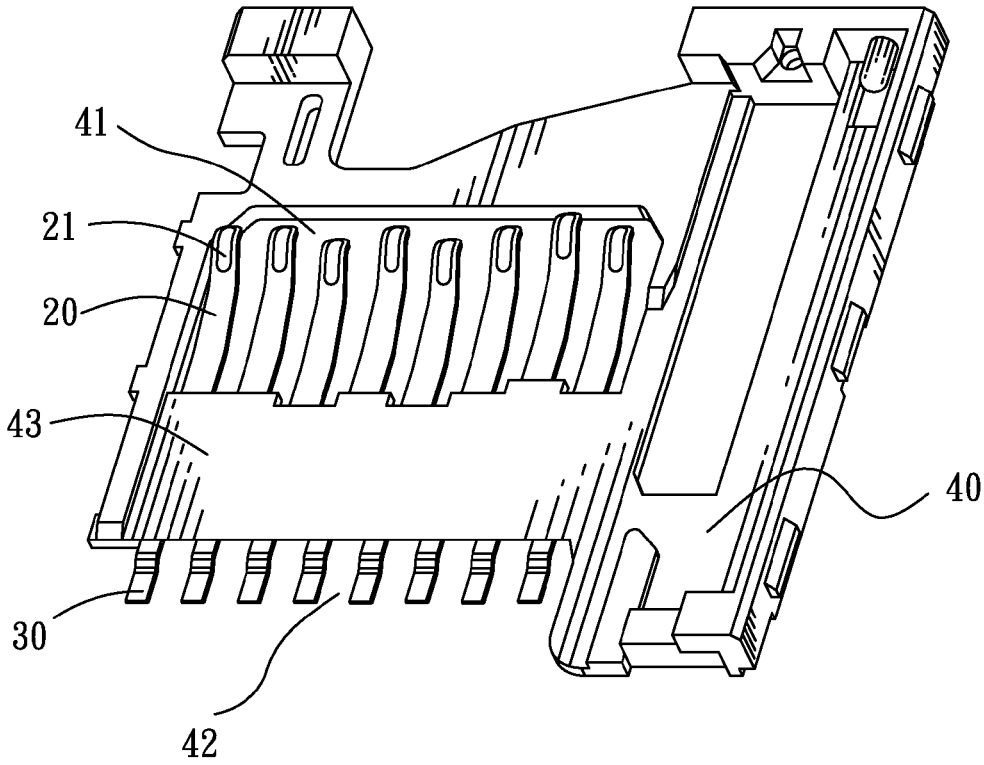
FIG. 2 is a perspective view of an assembly of an insulating housing and a plurality of electrical terminals of FIG. 1.
Figure 3:
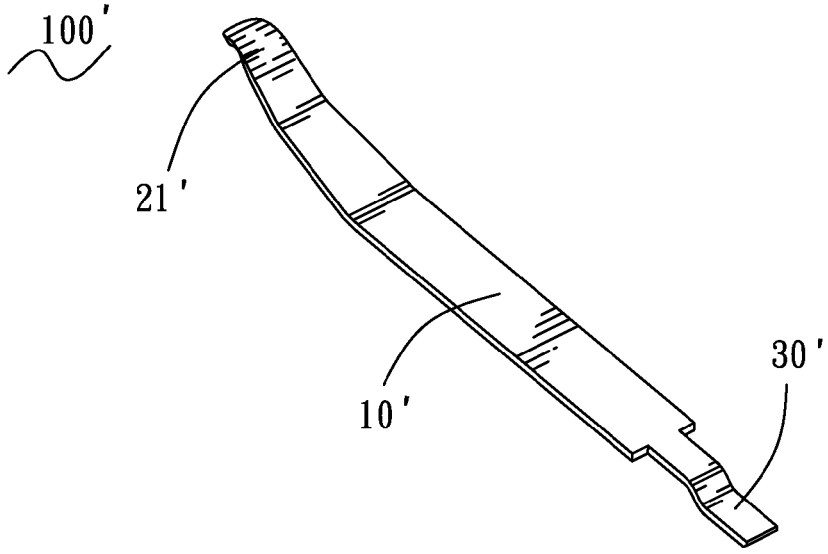
FIG. 3 (Prior Art)
FIG. 3 is a perspective view of an electrical terminal according to a prior art.

Referring to FIG. 1 and FIG. 2, an electrical terminal 100 in accordance with the present invention is shown. The electrical terminal 100 is used in a card connector and integrated with an insulating housing 40 of the card connector.

Referring to FIG. 1, the electrical terminal 100 has a long and narrow base plate 10. A middle of one end of the base plate 10 is bent perpendicularly and then extended along an extending direction of the base plate 10 to form a soldering portion 30. The other end of the base plate 10 extends towards a direction opposite to the soldering portion 30 to form an elastic portion 20. A free end of the elastic portion 20 further extends obliquely to form a contact portion 21 with a curved shape. A middle of the base plate 10 is perpendicularly punched to divide the base plate 10 into three parts designated as two first fastening plates 13 and a second fastening plate 11 which is connected between the two first fastening plates 13 by two connecting portions 12. So a bend is formed between the second fastening plate 11 and the first fastening plates 13. A pair of buckling tabs 14 is oppositely extended outwardly from two opposite side edges of each of the first fastening plates 13 and then bent towards a direction perpendicular to the corresponding first fastening plate 13 so as to make free ends of the buckling tabs 14 located at different planes with the first fastening plates 13. In this embodiment, the buckling tabs 14 are bent towards a direction in which the second fastening plate 11 is punched.

Referring to FIGS. 1-2 again, the insulating housing 40 is of a substantial rectangular shape and defines a receiving cavity 41 and a receiving opening 42 which are parallel to and spaced from each other. Accordingly, a bridge 43 is formed between the receiving cavity 41 and the receiving opening 42. The electrical terminals 100 are disposed in the bridge 43 at regular intervals along a longwise direction of the bridge 43 with the base plates 10 and the buckling tabs 14 being embedded in the bridge 43 by means of insert molding, the elastic portions 20 stretching into the receiving cavity 41, the contact portions 21 projecting out of the receiving cavity 41 for contacting a corresponding card (not shown), and the soldering portions 30 stretching into the receiving opening 42 for being soldered with a printed circuit board (not shown).

A method for integrating the electrical terminal 100 with the insulating housing 40 includes following steps: firstly, fix the electrical terminal 100 in a molding cavity of a mold (not shown); secondly, inject fluent plastic material into the molding cavity to mold the insulating housing 40 wrapping the base plate 10 and the buckling tabs 14 of the electrical terminal 100; and finally take out the assembly of the insulating housing 40 and the electrical terminal 100 from the molding cavity when the mold is opened. During molding, the fluent plastic material flows around the base plate 10 so as to make the first fastening plates 13, the second fastening plate 11 and the connecting portions 12 fully and firmly wrapped with the fluent plastic material due to the bend between the second fastening plate 11 and the first fastening plates 13. The buckling tabs 14 are buckled and embedded in the bridge 43 of the insulating housing 40 by means of making the fluent plastic material surround the buckling tabs 14. Therefore, this enhances the retention of the electrical terminals 100 in the insulating housing 40 to form a firm integration between the electrical terminals 100 and the insulating housing 40.

As describe above, the electrical terminal 100 utilizes the bend between the second fastening plate 11 and the first fastening plates 13 to ensure a firm integration between the base plate 10 and the insulating housing 40. Furthermore, the buckling tabs 14 are buckled and embedded in the bridge 43 of the insulating housing 40 during molding so that further make the electrical terminals 100 firmly integrated in the insulating housing 40. Therefore, an electrical connection between the card and the card connector is stable.

What is claimed is:

1. An electrical terminal integrated with an insulating housing by means of insert molding, comprising:

a base plate embedded in the insulating housing, a portion of the base plate being perpendicularly punched to divide the base plate into three parts designated as two first fastening plates and a second fastening plate which is connected between the two first fastening plates by two connecting portions, a bend being accordingly formed between the second fastening plate and the first fastening plates;

a pair of buckling tabs oppositely extended outwardly from two opposite side edges of each of the first fastening plates and then bent towards a direction perpendicular to the corresponding first fastening plate to make free ends of the buckling tabs located at different planes from the first fastening plates, and the buckling tabs being further buckled and embedded in the insulating housing;

a soldering portion being extended from one end of the base plate; and a contact portion being connected with the other end of the base plate, wherein during insert molding, a fluent plastic material flows around the base plate to make the first fastening plates, the second fastening plate and the connecting portions fully and firmly wrapped with the fluent plastic material due to the bend between the second fastening plate and the first fastening plates so as to form a firm integration between the electrical terminal and the insulating housing.

2. The electrical terminal as claimed in claim 1, wherein the buckling tabs are bent towards a direction in which the second fastening plate is punched.

3. The electrical terminal as claimed in claim 1, wherein the contact portion and the soldering portion are located in two opposite ends of the base plate for being exposed from two opposite edges of the insulating housing.

4. The electrical terminal as claimed in claim 3, wherein the other end of the base plate extends towards a direction opposite to the soldering portion to form an elastic portion, and a free end of the elastic portion further extends obliquely to form the contact portion with a curved shape.

* * * * *